US005888276A

United States Patent [19]

Price et al.

[11] Patent Number: 5,888,276

[45] Date of Patent: Mar. 30, 1999

[54] REDUCTION OF ELECTROSTATIC CHARGE IN WASTE BOTTLE

[75] Inventors: Michael J. Price; Andrew T. McKenna, both of Rochester; Bruce J. Parks, Bloomfield; Robert E. Rosdahl, Jr., Ontario; Douglas A. Lundy, Webster, all of N.Y.

[73] Assignee: Xerox Corporation, Stamford, Conn.

[21] Appl. No.: 714,716

[22] Filed: Sep. 16, 1996

[51] Int. Cl.[6] ..... B03C 3/30

[52] U.S. Cl. ..... 96/17; 55/459.1; 95/59; 95/78; 96/61; 96/69; 399/253

[58] Field of Search ..... 95/59, 78; 96/17, 96/61, 69; 55/459.1, 360; 399/252, 253, 257

[56] References Cited

U.S. PATENT DOCUMENTS

| | | | |
|---|---|---|---|
| 1,558,382 | 10/1925 | Marx | 96/61 X |
| 2,574,284 | 11/1951 | Prochazka | 96/17 X |
| 3,493,109 | 2/1970 | Carta et al. | 96/17 X |
| 4,010,011 | 3/1977 | Reif | 96/61 |
| 4,231,319 | 11/1980 | Waibel et al. | 399/253 |
| 4,352,681 | 10/1982 | Dietz | 96/61 |
| 4,478,613 | 10/1984 | Brettschneider et al. | 96/61 |
| 4,599,285 | 7/1986 | Haneda et al. | 430/54 |
| 4,624,559 | 11/1986 | Haneda et al. | 399/236 |
| 4,649,703 | 3/1987 | Dettling et al. | 96/61 X |
| 4,679,929 | 7/1987 | Haneda et al. | 430/54 X |
| 4,689,951 | 9/1987 | Polach | 96/61 X |
| 4,976,749 | 12/1990 | Adamski et al. | 96/61 X |
| 4,978,597 | 12/1990 | Nakahara et al. | 430/122 |

OTHER PUBLICATIONS

*Xerox* Disclosure Journal, vol. 23, Issue #1 (Jan.–Feb.) p. 39,1996.

*Primary Examiner*—Richard L. Chiesa
*Attorney, Agent, or Firm*—Annette L. Bade

[57] ABSTRACT

An apparatus for reducing electrostatic charge of particles in a waste container. In one embodiment the waste container is coated with a liquid having a viscosity sufficient to prevent tribocharging between the waste container and the waster toner particles, and to collect toner particles deposited from the cyclone separator into the waste container. Another embodiment describes the use of a flange extending into the waste container to prevent tribocharging that can cause explosions in the waste toner bottle.

15 Claims, 7 Drawing Sheets

REDUCTION OF ELECTROSTATIC CHARGE IN WASTE BOTTLE

This invention relates generally to an electrostatographic printer and copier, and more particularly, to the reduction of electrostatic charge created in a polyethylene waste bottle.

In general, electrostatic charge is generated when two dissimilar materials experience an aggressive rubbing contact with each other. This process is known as triboelectrification. The degree to which static is generated is dependent on how easily free electrons are transferred from one material to the other. This property is usually quantified by ranking materials on a Triboelectric Series. The greater the difference on the series, the larger the amount of static that can be generated for a given contact. When this electrostatic charge is generated on surfaces which do not have a path to ground, the charge will grow to a point where it is possible for arcing to occur. Under proper conditions, this arc can ignite toner as it is passing through the waste system. This small ignition in the presence of a toner cloud, which often exists in toner waste bottles, can cause a flash fire that backfire through the entire waste module, fusing toner to various components, potentially matting and/or melting the cleaner brushes, and adversely affecting customers' perception of the product in general.

In this particular case, the charge is generated as the toner and debris pass through the waste module system, specifically in the areas with turbulent flow. In the DESB (dual electrostatic brush) waste module system toner and debris are removed from the photoreceptor by entraining the waste in an airstream and depositing it into a waste bottle.

The following disclosures may be relevant to various aspects of the present invention and may be briefly summarized as follows:

U.S. Pat. No. 4,978,597 to Nakahara et al. discloses an image forming apparatus, including an electrostatic image-bearing member for holding an electrostatic charge image and a toner-carrying member having a surface for carrying magnetic toner on the surface. The surface of the toner-carrying member has an unevenness comprising sphere-traced concavities formed by blasting with particles with a definite spherical shape; the magnetic toner comprises 17–60% by number of particles of 5 microns or smaller, 1–23% by number of particles of 8–12.7 microns, and 2.0% by volume or less of particles of 16 microns or larger and has a volume-average particle size of 4–11 microns; the electrostatic image-bearing member and the toner-carrying member are disposed with a prescribed gap therebetween at a developing station; means for forming a magnetic toner layer on the toner-carrying member in a thickness which is thinner than the prescribed gap; and means for applying an alternating electric field for development with the magnetic toner at the developing station. The surface of the toner-carrying member comprising the sphere-traced concavities allows the forming of a uniform thin toner layer thereon when combined with the magnetic toner having a specific particle size distribution while the soiling of the surface is prevented for a long period of use.

U.S. Pat. No. 4,624,559 to Haneda et al. discloses a developing method for an electrostatic latent image that includes the steps of applying and retaining a layer of developer on a supporting sleeve, conveying the developer on the supporting sleeve to a development area, and regulating the quantity of the developer on the supporting sleeve by a developer regulating device before the developer is conveyed to the development area. The regulating step includes impressing a bias voltage so as to establish a field between the supporting sleeve and the regulating device in order to selectively retain developer on the supporting sleeve which has a desired polarity and quantity of charge for development. The developer regulating device may be a sleeve rotated in a direction opposite to the direction of rotation of the supporting sleeve, and has a bias voltage impressed thereon.

SUMMARY OF INVENTION

Briefly stated, and in accordance with one aspect of the present invention, there is provided a method for reducing electrostatic charge of particles in a container, comprising: coating an interior surface of the container with a soapy film; generating an airstream through a cyclone separator having waste particles entrained in the airstream; separating the waste particles from the airstream using a cyclone separator; collecting the waste particles separated from the airstream into a container; and trapping the waste particles guided into the container in the soapy film coating of the container thereby preventing aggressive rubbing contact between the particles and the interior surface of the container.

Pursuant to another aspect of the present invention, there is provided an apparatus for reducing electrostatic charge of particles in a container, comprising: a cyclone separator having an airstream flowing therethrough; and a waste container, having an interior surface and an exterior surface, opposed to one another, being coupled to the cyclone separator for collecting the particles separated from the airstream in the cyclone separator, the waste container enabling reduction of electrostatic charge generation between the particles and the interior surface of said waste container.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 7:
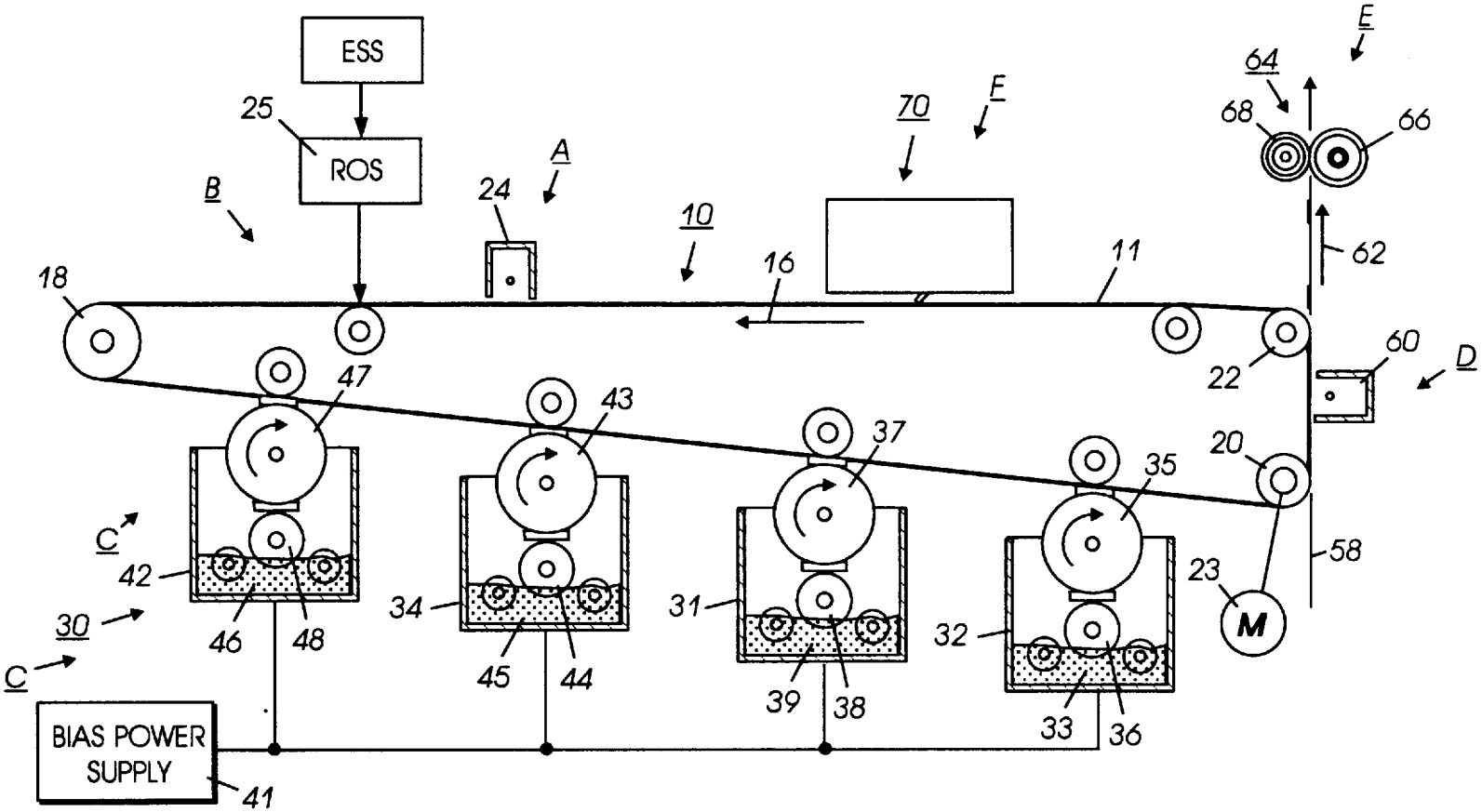
FIG. 7 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 7 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement past charging station A, and exposure station B, developer stations C transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 7, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush, blade or other type of cleaning system 70 and collected in a waste container.

Figure 1:
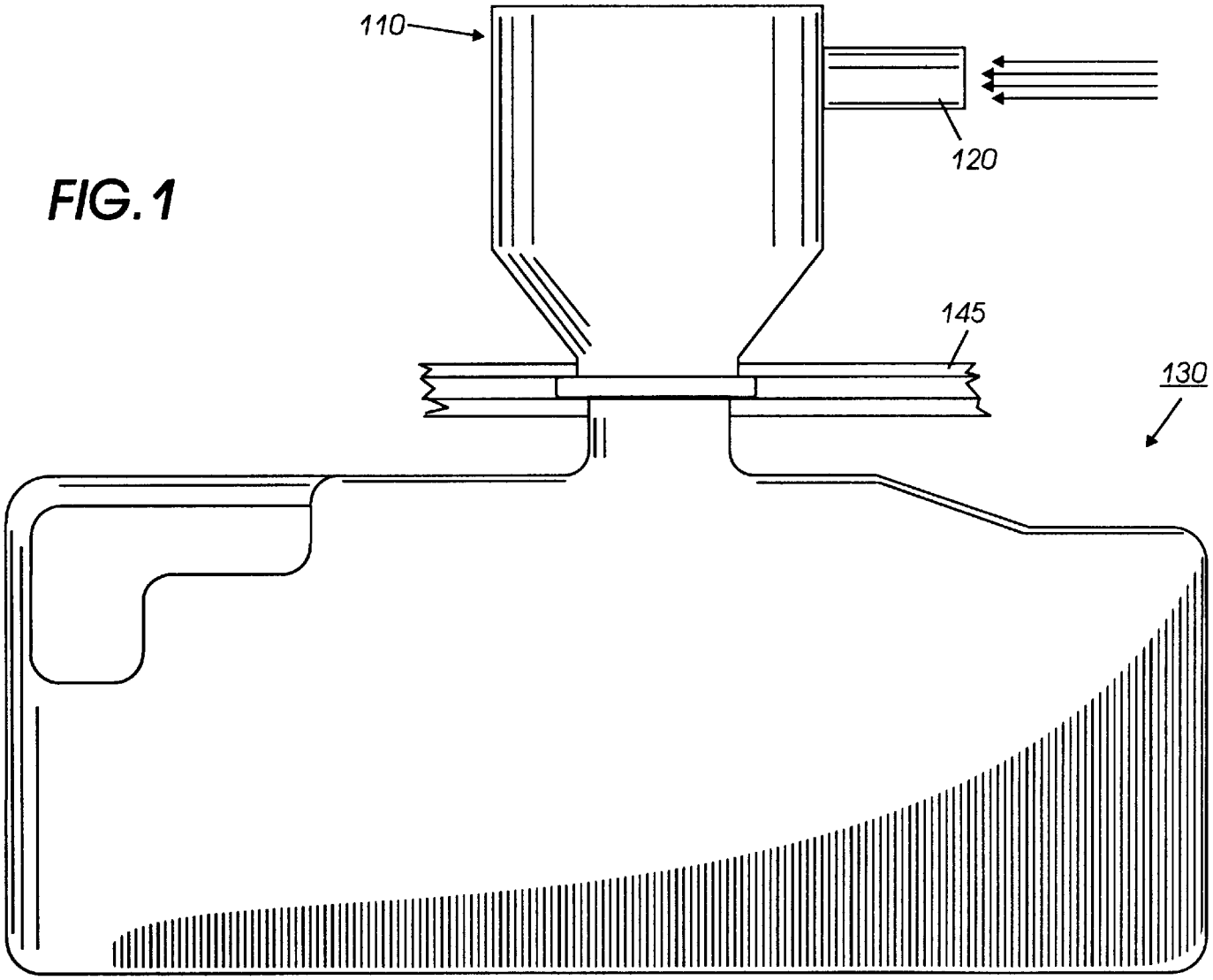
FIG. 1 is a schematic of a waster bottle and cyclone separator interface.
Figure 2:
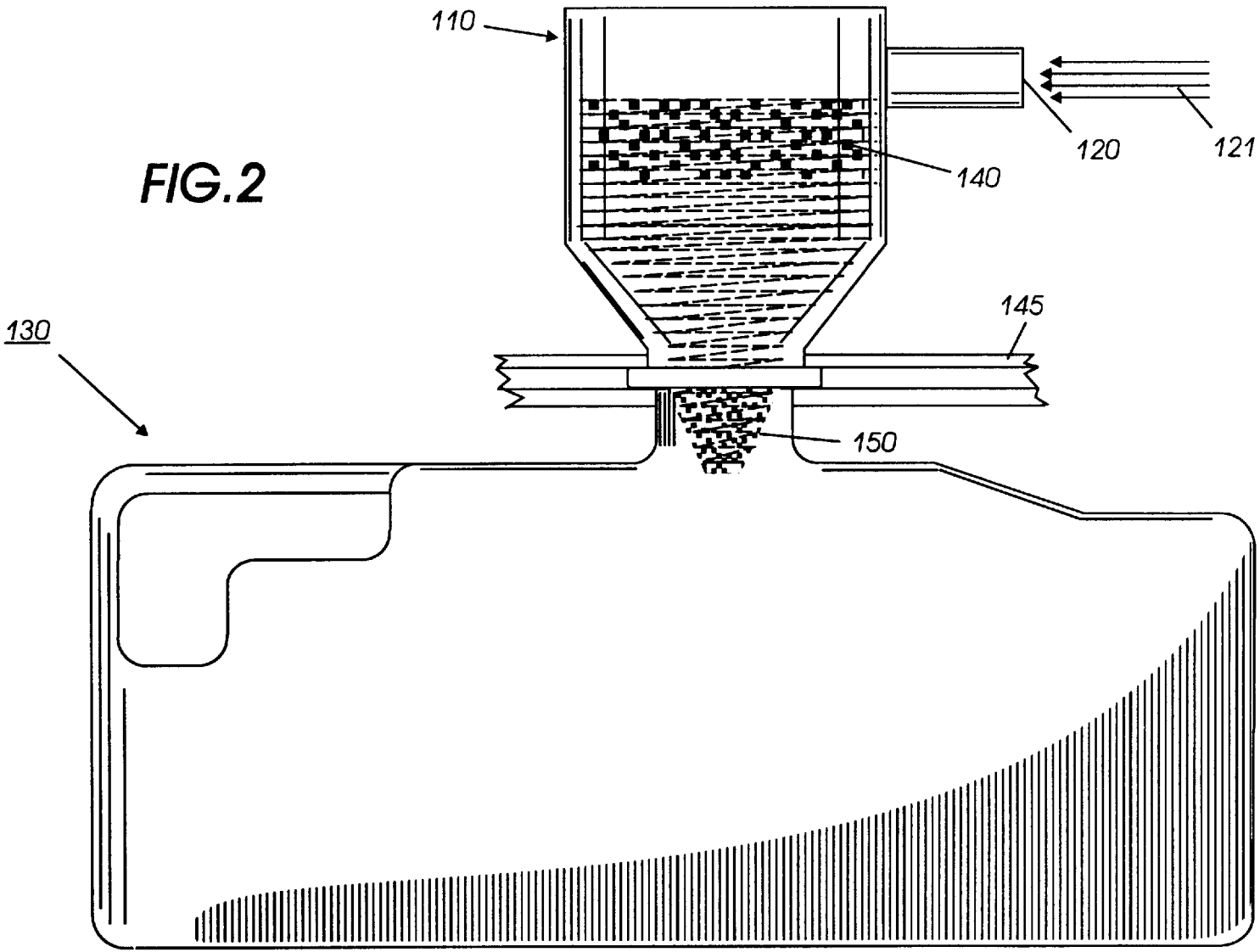
FIG. 2 is a schematic illustration of a cyclone separator with tribocharging between the polyethylene bottle and the waste material without soap film coating.
Figure 3:
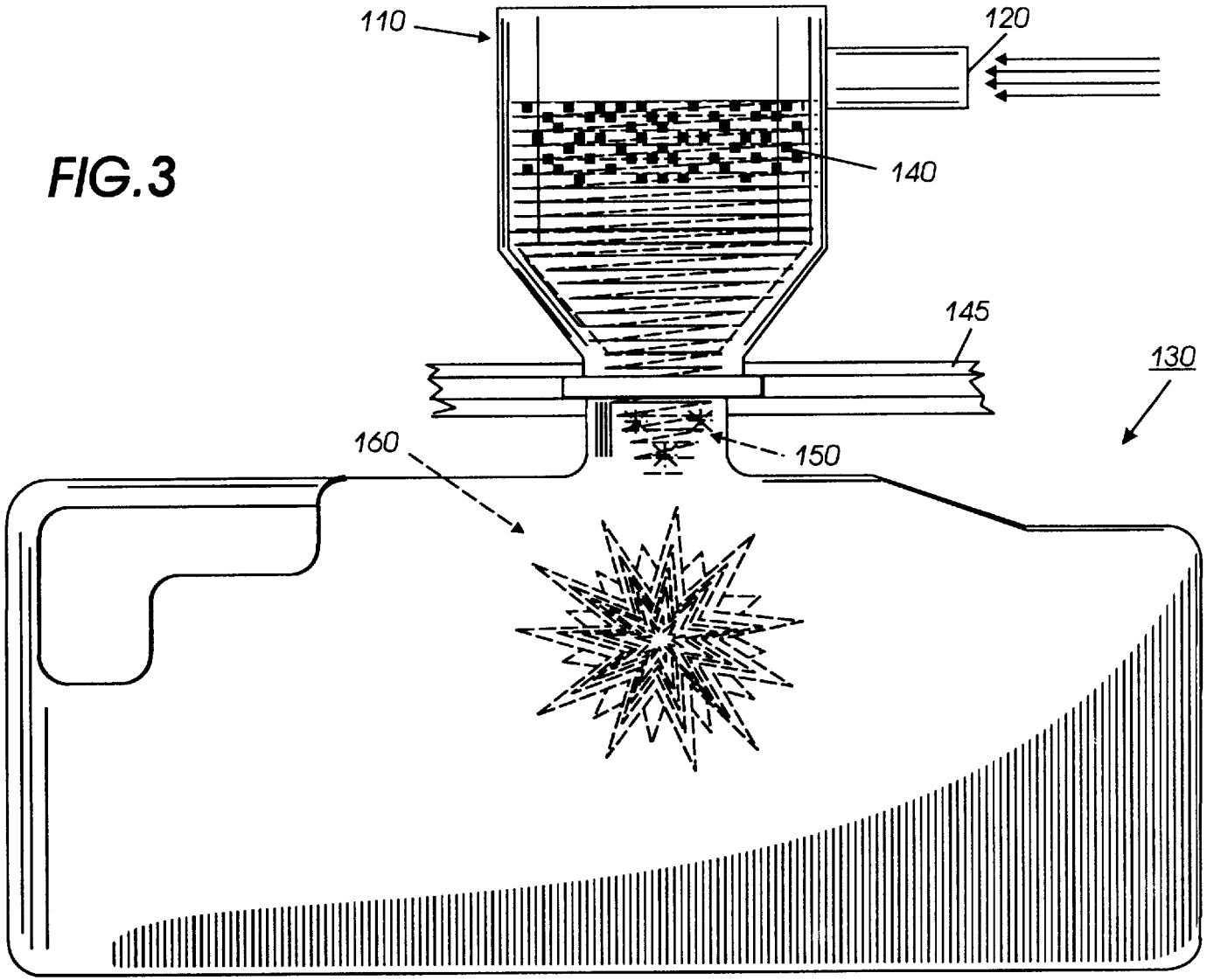
FIG. 3 is a schematic illustration with arc initiation of the waste particle cloud in the bottle.
Figure 4:
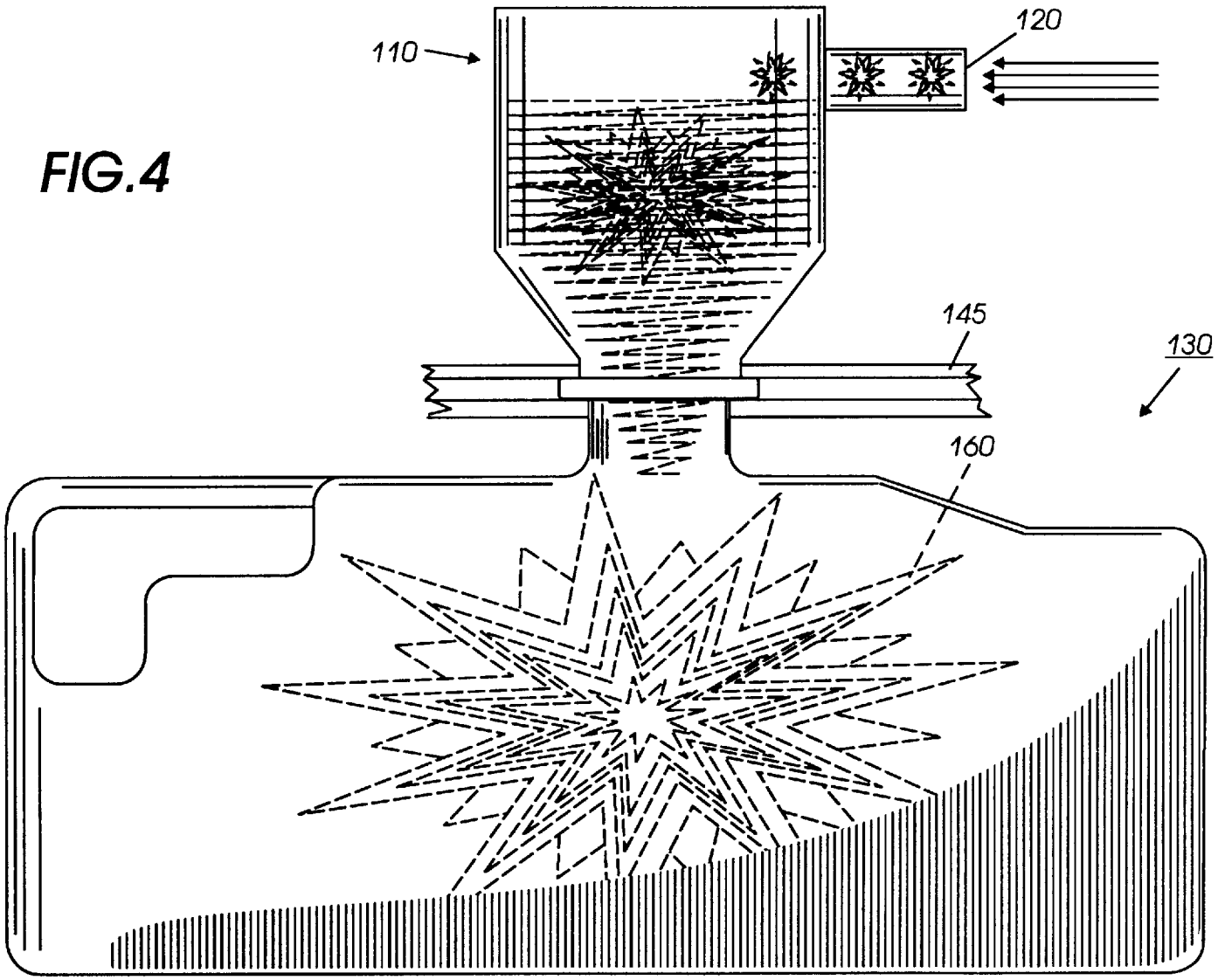
FIG. 4 is a schematic illustration of the propagation of complete ignition of the waste particle cloud in the waste bottle.

Reference is now made to FIGS. 1–4, which show progressively how the toner explosions occur in the waste bottle. FIG. 1 shows a standard waste toner inlet 120 for the airstream, entrained with waste particles, into the cyclone separator 110. The cyclone separator separates the waste particles from the airstream, collecting the waste particles in the waste bottle 130. FIG. 2 shows the waste particles 140 entering the cyclone separator in a cyclonic (i.e. tornado-like) motion. The particles entering the bottle from the separator shown by reference numeral 150 contain a high degree of tribocharging due to contact between the polyethylene bottle and the waste toner particles. In this particular case, the charge is generated as the toner particles and other debris pass through the waste module system, specifically in the areas with turbulent flow. In the DESB (dual electrostatic brush) waste module system, toner and debris are removed from the photoreceptor by entraining the waste in an airstream and depositing it into a waste bottle. FIG. 3 shows arcing to an exposed frame member 145 (i.e. supporting grounded machine frame) and/or the cyclone separator. This arcing results from the presence of a high degree of electrostatic electricity. The reference number 150 in FIG. 3 indicates the sparks of this arcing. The initiation of a ROEP (i.e. Radiation Oxidation of Electrostatic Particles) event 160 in the waste bottle occurs when an arc ignites the dust cloud of waste particles in the bottle. FIG. 4, reference number 160, shows a schematic of complete ignition of the waste cloud in the waste bottle 130. Once ignition has occurred the propagation of the flame front (i.e. leading edge of the expansion of frame) into the cyclone separator 110 from the waste bottle 130 occurs. Furthermore, the flame front continues to propagate throughout the waste module into the cleaner and the HAK (Hybrid Air Knife—read removal with air) assemblies as a result of an ROEP event.

Figure 5:
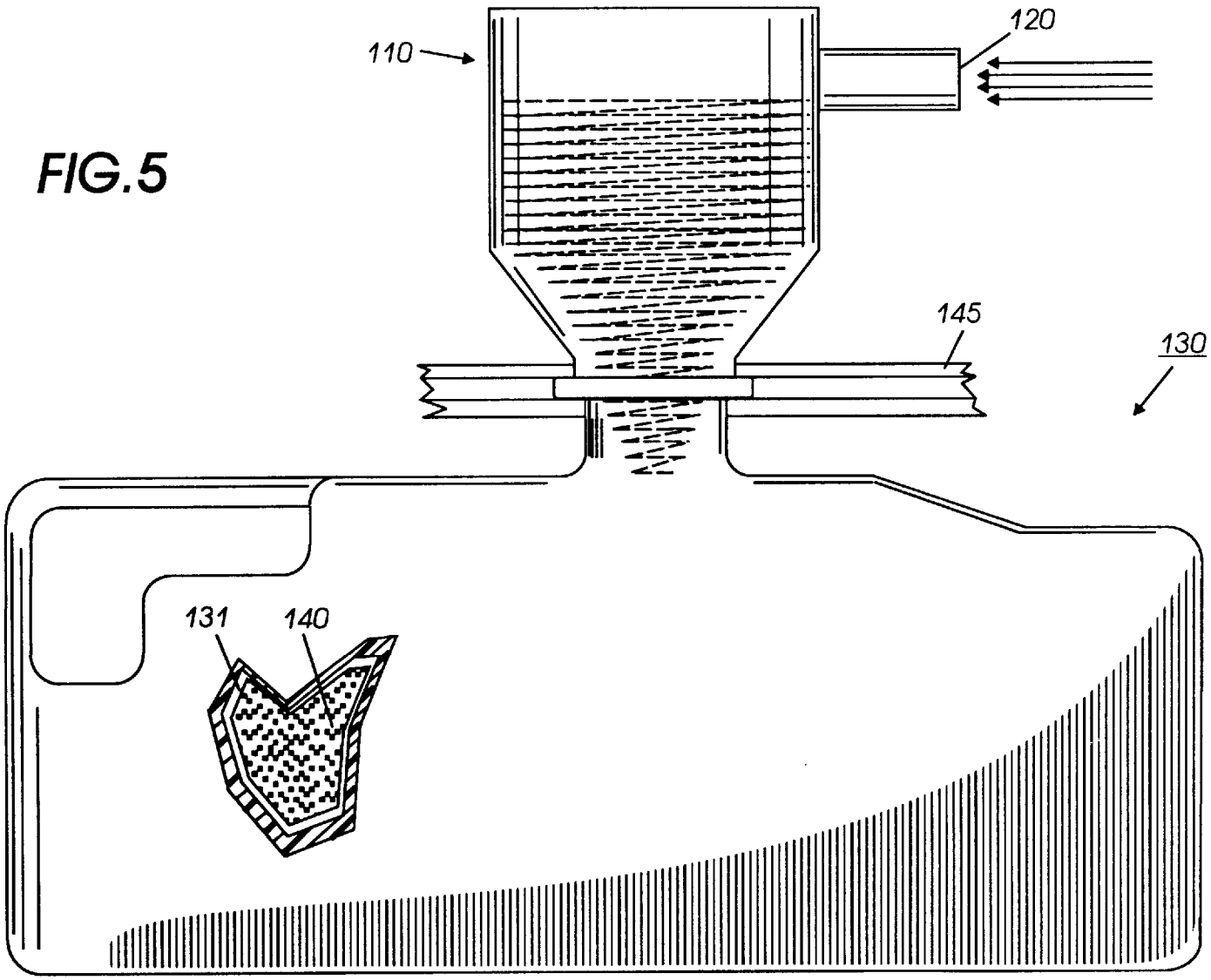
FIG. 5 is a schematic illustration of the waste bottle coated is with a soap film to prevent ROEP.

Three different methods for reducing/eliminating the generation of electrostatic charge were found. Reference is now made to FIG. 5, which discloses coating the inside walls opposes waste container. This method proposes that the generation of electrostatic charge would be completely eliminated, if the aggressive rubbing contact between the toner and waste bottle were prevented. The cyclone separator 110 of the waste module deposits the waste material 140, which is entrained in an airstream, into the bottle 130 by forcing the airstream 121 into a tornado-like motion. This cyclonic motion of the airstream as the waste toner particles are being deposited into the bottle results in a high degree of aggressive contact and thus, the generation of electrostatic charge when the bottle is made of standard grade polyethylene or other materials that charge well against toner. The use of a soapy film 131 in the area(s) of contact will prevent the generation of electrostatic charge by preventing the aggressive contact. The soap film 131 has a thickness of about 1 mm to about 2 mm prior to collection of the particles 140 in the film 131. The soap film 131 is able to trap and retain the waste forming a toner/soap paste. The waste will continue to be trapped by the film until the paste grows to a thickness of about 2 mm to about 5 mm. At this point, the aggressive contact is essentially toner on toner, which will not tribocharge to a significant degree. Liquids with a viscosity of about 5 cp to 225 cp for a temperature range of about 25° C. to about 100° C. similar to that of liquid laundry detergent or hand soap is sufficient to cling to the side walls of the bottle and still trap the waste as it enters the bottle. Experimentation with double back tapes disclosed that these tapes were not able to trap the toner sufficiently to prevent the generation of electrostatic charge.

Figure 6:
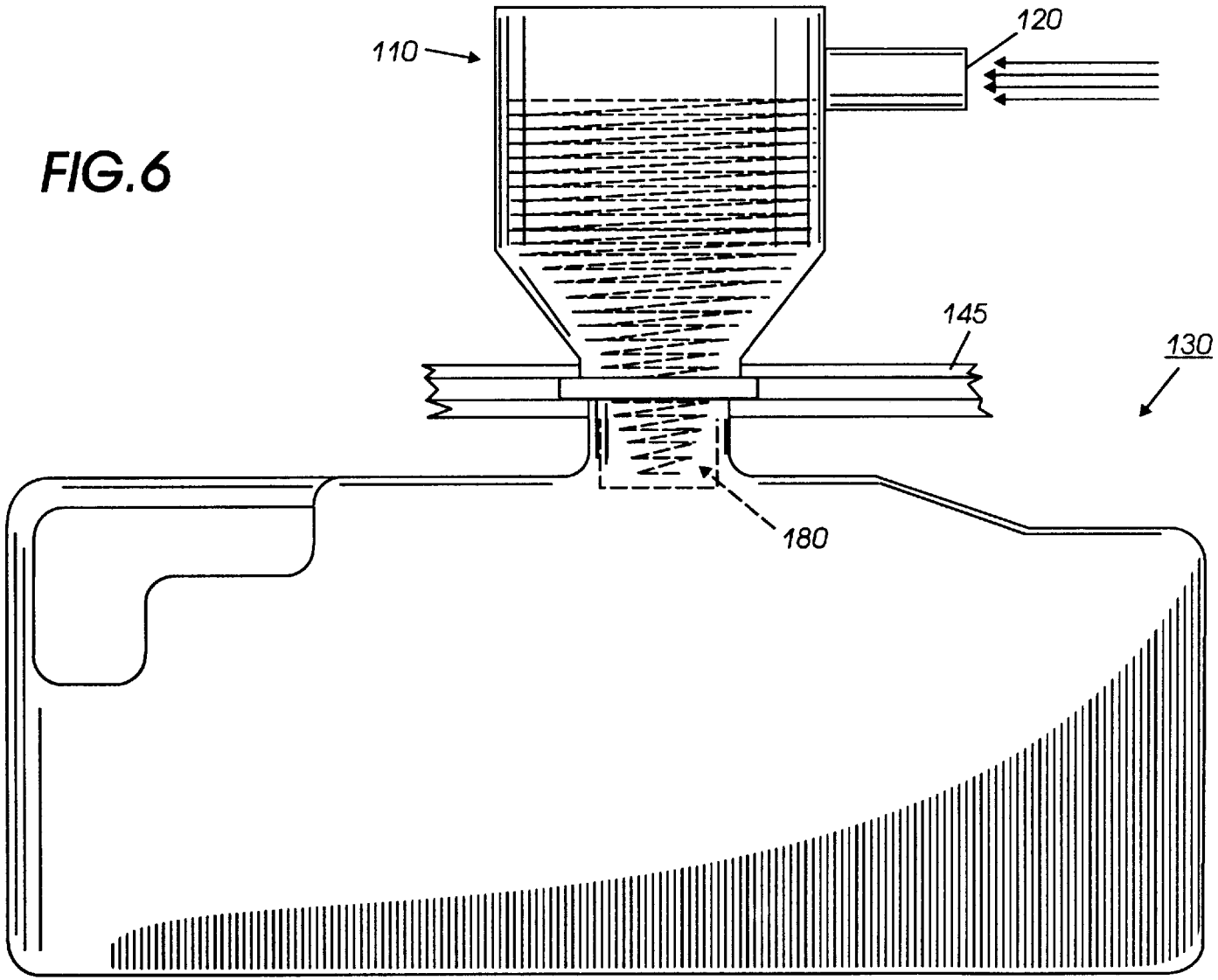
FIG. 6 is a schematic illustration of an alternate embodiment that minimizes tribocharging between the waste toner and the flange, of the present invention, with an extended rib.

Reference is now made to FIG. 6, which shows an alternate embodiment of the present invention to reduce the explosions that occur in the waste bottle due to triboelectrification. This method uses a conductive path to ground to dissipate the electrostatic charge as it is generated. This method has both a short term and long term application. In the short term, while the long term application is being developed, a thin aluminum collar 180 is provided. This collar 180 is inserted into a waste bottle 130 to a depth of about 40 mm and connected to machine ground. While the insert 180 does not lessen the degree to which the static is generated, it provides a vehicle for the static to dissipate to an electrical ground. By preventing the continual build-up of static, fewer, if any, electrical arcs occur in the waste bottle thus, eliminating the catalyst for a ROEP (Rapid Oxidation of Electrostatic Particles) event. The aluminum insert 180 drastically reduces, and in many cases eliminates the frequency with which the ROEP events (i.e. toner flash fires) occur. The long term solution, which is very similar to the short term solution, is to change the design of the waste bottle. The flange 180 of the bottle 130, has been adapted to extend into the bottle 130 to a depth of about 40 mm. Also, the material of the flange 180 is a highly conductive polyethylene rather than the insulative material previously used. Similarly, the cleaner assembly has an aluminum manifold.

A third method, proposes that the generation of electrostatic charge is prevented by identifying a material for the waste bottle that exhibits similar triboelectric behaviors as toner. A classic example of generating an electrostatic charge is rubbing an inflated balloon on one's head, assuming one has a sufficient amount of hair, and sticking the balloon to a wall. The aggressive rubbing action of the rubber of the balloon and human hair generates sufficient charge that the balloon will adhere to a wall. The contact of rubber on rubber or hair on hair does not generate nearly the same degree of electrostatic charge. This property of triboelectrification can be applied to the ROEP problem in machine waste modules. As previously mentioned, if a plastic material similar to the toner were identified, and able to be used in conjunction with the waste bottle, electrostatic charge would not be generated and ROEP would be eliminated. Interestingly enough, the long-term solution mentioned in the second method had this effect. The material used for the flange disclosed in the second method, is a grade of polyethylene that is made highly conductive with the addition of carbon platelets. Initial testing of the prototypes indicated that the electrostatic charge was still generated with the conductive material, but was able to dissipate to ground and thus able to prevent the occurrence of ROEP events. These initial prototypes were made from an injection mold that was not designed for this conductive polyethylene. The gates in the mold caused the breakage of the carbon platelets into smaller pieces and adversely affected the conductivity of the material (i.e. loss of material conductivity). Testing of the first samples from the properly designed injection mold showed that only a minimal amount, if any, of electrostatic charge is generated. Hence, it was concluded that the material (i.e. conductive polyethylene), when used in a properly designed injection mold provides the proper triboelectric properties that will not adversely interact with toner when in aggressive contact. It is noted that not only is the material capable of dissipating charge, but the material does not tribocharge with toner when the path to ground is lost.

In recapitulation, the present invention prevents triboelectrification by utilizing either a soapy film in the waste bottle container or a flange inserted into the waste bottle. A third embodiment requires the identification of a material for the waste bottle that exhibits similar triboelectric behaviors as toner. These embodiments prevent ROEP (i.e. flash toner fires) from occurring in the cleaning subsystem and particularly in the toner waste container.

It is, therefore, apparent that there has been provided in accordance with the present invention, a reduction of electrostatic charge in the waste module that fully satisfies the aims and advantages hereinbefore set forth. While this invention has been described in conjunction with specific embodiments thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus in an electrostatogralphic apparatus for reducing electrostatic charge of toner particles in a container, comprising:

a cyclone separator having an airstream carrying said toner particles flowing therethrough; and a toner waste container, having an interior surface and an exterior surface, opposed to one another, being coupled to said cyclone separator for collecting the toner particles separated from the airstream in said cyclone separator, said waste container enabling reduction of electrostatic charge generation between the toner particles and the interior surface of said waste container.

2. An apparatus as recited in claim 1, further comprising a flange being inserted into said waste container.

3. An apparatus as recited in claim 2, wherein said flange is inserted into the container a distance of about 40 mm, said collar being connected to machine ground.

4. An apparatus as recited in claim 2, wherein said flange having a first end opposite a second end, said second end being inserted into said waste container until said first end is flush with a plane in which said waste container and said cyclone separator meet.

5. An apparatus as recited in claim 4, wherein said flange comprises a conductive material.

6. An apparatus as recited in claim 5, wherein said flange comprises a material selected from the group consisting of aluminum and polyethylene.

7. An apparatus as recited in claim 5, wherein said flange comprises: an aluminum collar being inserted into the container a distance of about 40 mm, said collar being connected to machine ground.

8. An apparatus as recited in claim 7, wherein the thickness of said collar being of sufficient continuity to move charge from one area to another along said collar.

9. An apparatus as recited in claim 1, further comprising a film coated on the interior surface of said waste container.

10. An apparatus as recited in claim 9, wherein said film comprises polyethylene.

11. An apparatus as recited in claim 9, wherein said film comprises a thickness range of about 1 mm to about 2 mm.

12. An apparatus as recited in claim 11, wherein said film comprises a viscosity range of about 5 cp to about 225 cp for a temperature range of about 25° C. to about 100° C.

13. An apparatus as recited in claim 12, wherein the particles exiting said cyclone separator are collected in said film forming a paste.

14. An apparatus as recited in claim 13, wherein the paste accumulates a thickness of about 2 mm to about 5 mm.

15. An apparatus in an electrostatographic apparatus for reducing electrostatic charge of toner particles in a container, comprising:

a cyclone separator having an airstream carrying said toner particles flowing therethrough; and a toner waste container, having an interior surface and an exterior surface, opposed to one another, being coupled to said cyclone separator for collecting the toner particles separated from the airstream in said cyclone separator, said waste container having a film coated on the interior surface enabling reduction of electrostatic charge generation between the toner particles and the interior surface of said waste container.

* * * * *